US005494771A

United States Patent [19]

Seki et al.

[11] Patent Number: 5,494,771

[45] Date of Patent: Feb. 27, 1996

[54] SEPARATING AND RECOVERING METHOD OF CONTINUOUSLY COATED PHOTORECEPTOR DRUM

[75] Inventors: Hirohiko Seki; Nobuaki Kobayashi; Daisaku Tsuji; Akira Ohira; Makoto Kon, all of Hachioji, Japan

[73] Assignee: Konica Corporation, Tokyo, Japan

[21] Appl. No.: 229,405

[22] Filed: Apr. 18, 1994

[30] Foreign Application Priority Data

| | | | |
|---|---|---|---|
| Apr. 26, 1993 | [JP] | Japan | 5-099559 |
| Apr. 26, 1993 | [JP] | Japan | 5-099562 |
| May 26, 1993 | [JP] | Japan | 5-124270 |

[51] Int. Cl.[6] ..... G03G 5/00

[52] U.S. Cl. ..... 430/133; 29/426.3; 225/4

[58] Field of Search ..... 430/133, 127; 427/346; 118/DIG. 11; 264/159; 29/426.3, 426.5, 527.2; 225/4

[56] References Cited

U.S. PATENT DOCUMENTS

| | | | |
|---|---|---|---|
| 3,689,311 | 9/1972 | Loeffler et al. | 118/DIG. 11 |
| 4,947,534 | 8/1990 | Davenport | 29/426.5 |
| 4,972,569 | 11/1990 | Aoki et al. | 118/DIG. 11 |
| 5,167,058 | 12/1992 | Armstrong, Jr. | 29/426.5 |

FOREIGN PATENT DOCUMENTS

| | | | |
|---|---|---|---|
| 59-174844 | 10/1984 | Japan | 430/133 |
| 60-95546 | 5/1985 | Japan | 430/133 |

OTHER PUBLICATIONS

English Abstract of JP 61–120662 (Jun. 1986).
English Abstract of JP 61–120663 (Jun. 1986).
English Abstract of JP 61–120664 (Jun. 1986).

*Primary Examiner*—Christopher D. Rodee
*Attorney, Agent, or Firm*—Frishauf, Holtz, Goodman, Langer & Chick

[57] ABSTRACT

In a method of manufacturing a photoreceptor drum which has been coated and then quick dried, the drum having a plurality of vertically-stacked base drums that are coated and dried from the uppermost base drum toward a lowermost base drum. The uppermost base drum is held by a second holding member, and a next lower base drum is held by a first holding member respectively. Thereafter the uppermost base drum is separated from the next lower base drum.

14 Claims, 12 Drawing Sheets

ECCENTRICITY=0

ECCENTRICITY=r

ECCENTRICITY>r

CHARACTERISTIC DIAGRAM OF WIND SPEED AND DRYING TIME

SEPARATING AND RECOVERING METHOD OF CONTINUOUSLY COATED PHOTORECEPTOR DRUM

BACKGROUND OF THE INVENTION

The present invention relates to a method comprising the steps of coating and drying photoreceptor base drums used for electrophotography which are vertically conveyed under the condition that they are longitudinally connected, and also relates to a method comprising the step of successively separating the photoreceptor drums which have been coated.

When the surfaces of photoreceptor base drums are continuously coated and dried under the condition that the base drums are stacked and the end faces are butted, the stacked base drums are connected with each other by the dry coating films, so that the base drums can not be easily separated.

Although a means is provided for separating the base drums immediately after the coating operation has been completed, it is not appropriate to apply the means to a case where the coating solution is of a quick drying type, and also it is not appropriate to apply the means to a case where the coated base drums are sent into a drier for stopping the flow of the coating solution on the drum surfaces.

Japanese Patent Publication Open to Public Inspection Nos. 120662/1986, 120663/1986 and 120664/1986 disclose technique in which the coating and separating operation is performed under the condition the base drums are stacked through spacers. However, when vibration is caused by the separating means, the vibration is transmitted to the base drums which are being continuously coated. As a result, deviation of coated film thickness is increased.

Since the coating solution flows down on the base drum surface immediately after it has been coated, it is preferable that the base drum coated with the photoreceptor coating solution is quickly put into the drying process immediately after the completion of coating operation.

In the case where the base drums have been connected with each other by the dry coating film, a means is used, in which one base drum is pulled upward when the conveying speed of the base drum is increased. However, this method is disadvantageous in that the adjacent drums are also pulled upward.

There is provided a method in which the base drum to be separated is vibrated, and also provided a method in which the base drum to be separated is seized with a chuck to change the axial direction of the base drum. According to these methods, deviation is caused in the coating film thickness, and further the base drums collapse due to the vibration, so that the manufacture can not be stably carried out.

According to the method in which the coating film is quickly dried with a drier immediately after the coating operation has been completed, advantageous effects can be provided with respect to the coating film. However, even when the base drum is dried with the drier, in some cases, the coating film can not be sufficiently dried depending on the characteristics of the coating solution and the film thickness to be obtained. In the case where the coating film has not reached a condition of set to touch, the base drum can not be directly held. Therefore, it is difficult to separate and recover the base drum.

The present invention has been achieved to solve the above problems. The first object of the present invention is to stably separate and recover a coated photoreceptor drum even when continuously coated base drums are stacked according to the continuous coating method, without causing vibration and slippage of the base drum position.

Also, the present invention relates to a drier for drying the photoreceptor for electrophotographic use after the photosensitive layer has been coated.

Conventionally, there are provided two types of driers for drying the photosensitive layer immediately after the completion of coating. One is a type of drier in which air is directly blown against the base drum immediately after the coating operation has been completed. This type of drier is disclosed in Japanese Patent Publication Open to Public Inspection Nos. 73074/1984 and 4471/1987. The other is a type of drier in which sucked air is used for drying the photosensitive layer, wherein a draft is used as disclosed in Japanese Patent Publication No. 4470/1987.

The drier disclosed in Japanese Patent Publication Open to Public Inspection Nos. 73074/1984 and 4471/1987 in which air is blown to the coating film, is disadvantageous in that the coating film is damaged or the coating film thickness deviates since the air flow collides with the coating film.

The drier disclosed in Japanese Patent Publication Open to Public Inspection No. 4470/1987 in which sucked air is used for drying the coating film, is disadvantageous in that the coating film thickness deviates due to the turbulence caused in the draft. Therefore, the coating film thickness tends to deviate.

According to the aforementioned methods, the lower the viscosity of the coating solution is, the more the coating film thickness deviates. Also, time from the completion of coating to the start of drying is an important factor. After the coating film has been naturally dried for a predetermined period of time, the aforementioned method can be applied. However, the aforementioned methods are not appropriate when they are applied immediately after the completion of coating operation.

According to the present invention, the problems described above can be solved. It is the second object of the present invention to evaporate the coating solvent uniformly and quickly without affecting the coating film immediately after the completion of coating. Further, it is the second object of the present invention to provide a drier in which the occurrence of turbulence is suppressed in the region close to the coating film surface to be dried and solvent vapor staying along the coating film is removed so as to complete a uniform and stable photosensitive layer.

SUMMARY OF THE INVENTION

The first object of the present invention can be accomplished by one of the following technical means.

First Embodiment (a) A method for separating and recovering a continuously coated photoreceptor drum which is a method for manufacturing a photoreceptor for electrophotographic use in which continuously stacked base drums are continuously coated with a photosensitive layer film and then the base drums are dried, separated and recovered, the method for separating and recovering a continuously coated photoreceptor drum characterized in that: a coated base drum to be separated is separated and recovered while an adjacent base drum which has already been coated with a photosensitive layer is being held.

(b) A method for separating and recovering a continuously coated photoreceptor drum according to item (a), characterized in that: a coated base drum to be separated is separated and recovered while an inner surface of a coated base drum adjacent to the coated base drum to be separated is being held.

(c) A method for separating and recovering a continuously coated photoreceptor drum according to item (b), characterized in that: the base drum to be separated is rotated so as to cut off the coating film by shearing force.

(d) A method for separating and recovering a continuously coated photoreceptor drum according to item (a), characterized in that: a coated base drum to be separated is separated from a coated base drum adjacent to the coated base drum to be separated while a non-image region of the coated base drum is being coated.

(e) A method of manufacturing photoreceptors for electrophotography characterized in that: base drums 2 which are continuously, concentrically and vertically stacked are coated with a photoreceptor layer film while the base drums 2 are moved upward; after the coating has been completed, the base drums 2 are dried; and then the base drums 2 are separated from each other and recovered. The method of manufacturing photoreceptors for electrophotography is further characterized in that: upper and lower clamp members 38A, 38B are movably provided concentrically with the base drums 2A, 2B so that the inside surface of the uppermost coated base drum 2A to be separated and the inside surface of the coated base drum 2B adjacent to the uppermost coated base drum 2A can be respectively clamped by the clamp members 38A, 38B; after the cramp members 38A, 38B have clamped the base drums 2A, 2B, the clamp members 38A, 38B are relatively and vertically moved a little by a short distance movement means 37 so that the base drums 2A, 2B are separated; after the separation of the base drums 2A, 2B, the lower clamp member 38B is turned off and the upper drum 2A is pulled up by a movement means 6 directly connected with the upper and lower clamp members 38A, 38B, the movement means 6 integrally moving the upper and lower clamp members 38A, 38B; at the same time, the lower clamp member 38B is moved upward by a lower clamp member movement means 40; and at least a portion of the lower clamp member 38B is accommodated inside the upper drum 2A clamped by the clamp member 38A.

(f) It is preferable that the upper drum 2A is rotated together with the upper clamp member 38A when the above relative separation is achieved.

(g) It is preferable that an interval between the drum 2A at the time when it has been lifted at the maximum in the process of recovery and the drum 2B, is sufficient for inserting a sliding table used for recovery.

(h) It is preferable that the drums 2A, 2B are relatively separated in a vertical direction during a period of time in which a non-image region is coated.

Second Embodiment (i) A method for separating and recovering a continuously coated photoreceptor drum which is a method for manufacturing a photoreceptor for electrophotographic use in which continuously stacked base drums are continuously coated with a photosensitive layer film and then the base drums are dried, separated and recovered, the method for separating and recovering a continuously coated photoreceptor drum characterized in that: a coated base drum to be separated which is held by an upper chuck working as a holding means, is separated and recovered from an adjacent coated base drum which is held by a lower chuck working as a holding means.

(j) A method for separating and recovering a continuously coated photoreceptor drum according to item (i), characterized in that: the holding means for holding the coated base drum adjacent to the coated base drum to be separated, is air support.

(k) A method for separating and recovering a continuously coated photoreceptor drum according to item (i), characterized in that: an air support device is provided under the lower chuck for centering the base drum.

(l) A method for separating and recovering a continuously coated photoreceptor drum according to item (i), characterized in that: the upper shaft moving upward at the same speed as that of the base drum to be separated has a rotational center shaft perpendicular to the moving direction; and when the upper chuck moves the base drum to be separated in a direction perpendicular to the base drum axis, the base drum to be separated is rotated around the rotational center shaft, so that the base drum to be separated can be separated from the adjacent base drum.

(m) A method for separating and recovering a continuously coated photoreceptor drum according to item (1), characterized in that: a distance d from the axial center of the base drum to be separated to the rotational center shaft, and a radius r of the drum satisfies the inequality of $r \leqq d$.

(n) A method for separating and recovering a continuously coated photoreceptor drum according to item (1), characterized in that: a control member for adjusting the rotational speed of the rotational center shaft is provided.

The second object of the present invention can be accomplished by the following technical means.

(1) A drier for drying a photoreceptor layer film coated on the surface of the base drum used for electrophotography, comprising: a circumferential direction uniformly sucking ring-shaped member concentrically provided in the middle portion of a cylindrical member into which the base drum can be inserted, wherein a turbulence is caused in a gap portion formed between the base drum surface and the inner surface of the cylindrical member when the base drum is inserted into the cylindrical member. In this way, the coating film can be quickly dried.

(2) The drier according to the item (1), wherein the condition of the turbulence satisfies the inequality of $Re<5.3\times10^3$.

(3) The drier according to the items (1) and (2), wherein the concentration of solvent in the drier is controlled when the length of the cylindrical member, the dimensions of a suction slit member attached to the cylindrical member, and wind velocity of the turbulence are changed.

(4) The drier according to the item (3), wherein the air quantity can be adjusted by changing the inner diameter of the cylindrical member.

(5) The drier according to the items (1), (2), (3) and (4), wherein a ring-shaped sliding coater is concentrically provided in series.

BRIEF DESCRIPTION OF THE DRAWINGS

FIG. 2(*b*) is a sectional view showing the coating condition of the coater by which the photoreceptor drum is coated.

DETAILED DESCRIPTION OF THE PREFERRED EMBODIMENT

An embodiment of the present invention will be described as follows.

Figure 2:
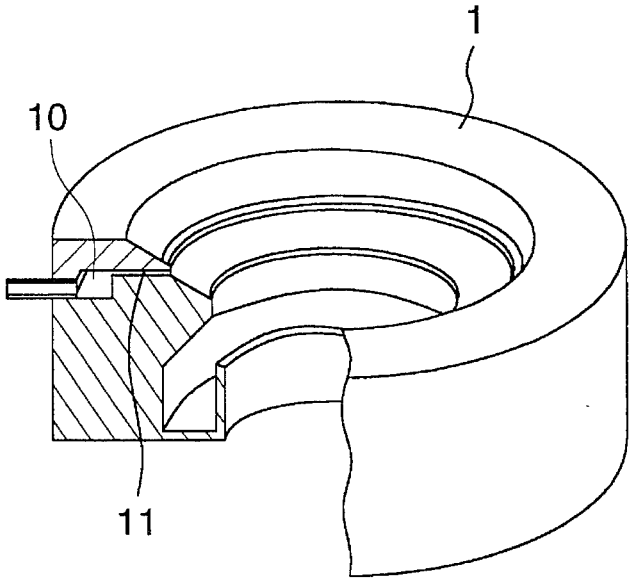
FIG. 2(*a*) is a partially sectional perspective view of the coater.
Figure 2:
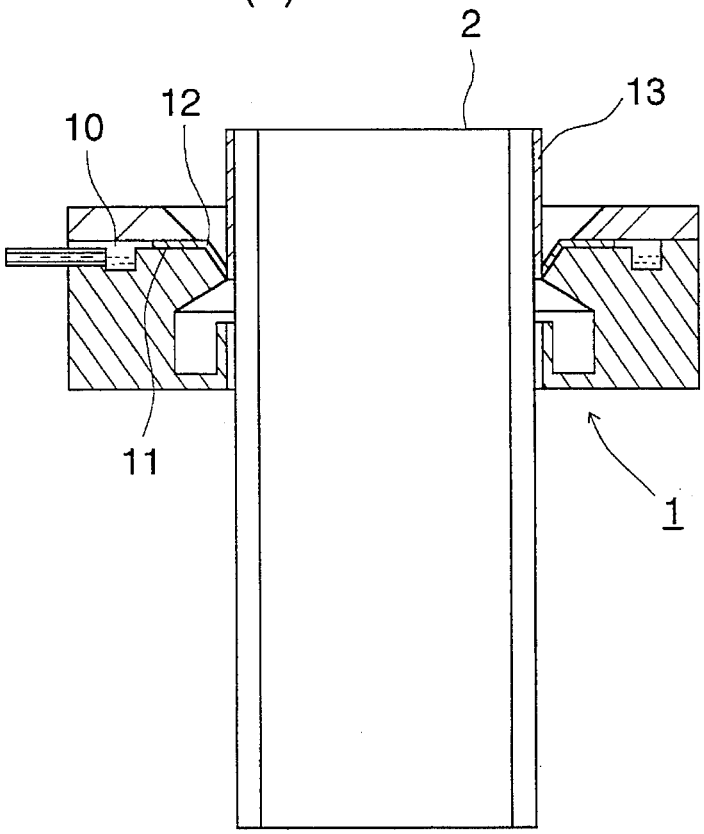

The coating operation is carried out using the ring-shaped coater 1 shown in FIG. 2(*a*), which is a partially sectional perspective view, and also shown in FIG. 2(*b*), which is a sectional view. In FIG. 2(*b*), the conditions of the coater 1 and base drum 2 are shown in the process of coating. The base drum 2 is coated by the coater 1 in the following manner: The coating solution is supplied from a coating solution distribution chamber 10, and passes through a coating solution distribution slit 11. Then the coating solution forms a sliding surface 12, and the circumferential surface of the base drum 2 is coated with a coating film 13.

Figure 3:
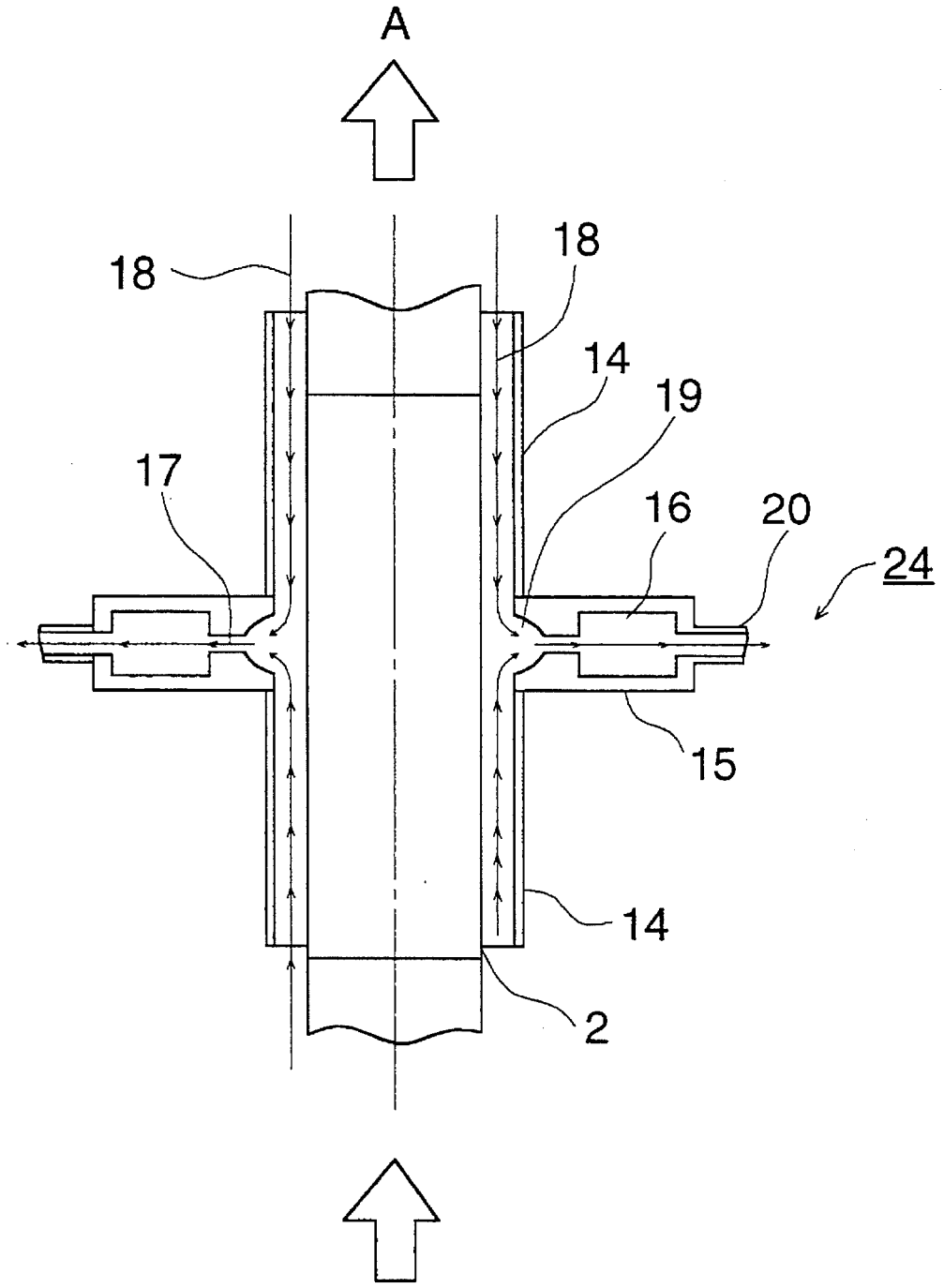
FIG. 3 is a sectional view of the drier.

The base drum 2 coated with the coating solution is conveyed in the arrowed direction through a drier 24 shown in the sectional view of FIG. 3. While the base drum 2 is vertically conveyed, it is dried. The drier 24 includes: a suction slit member 15 having a suction slit 17, suction chamber 16 and suction nozzle 20; and cylinder members 14 for rectifying the flow, which are concentrically attached to the upper and lower portions of the suction slit member 15.

The sucking operation is conducted by a plurality of suction nozzles 20, and then the sucked air flow is made uniform with respect to the circumferential direction by the action of the suction chamber 16 and the suction slit 17 which are constructed to be uniform with respect to the circumferential direction. In this case, a turbulence of air is caused in a space formed between the inner surface of the suction slit member 15 and the outer circumferential surface of the coated base drum 2, and a turbulence of air is also caused in a space formed between the inner surfaces of the upper and lower cylindrical members 14 and the outer circumferential surface of the coated base drum 2. The turbulence is a little suppressed by a buffer space 19, and a uniform air flow 18 is made for drying the base drum.

As described above, the coating film is dried until it does not flow down by its own weight.

Figure 1:
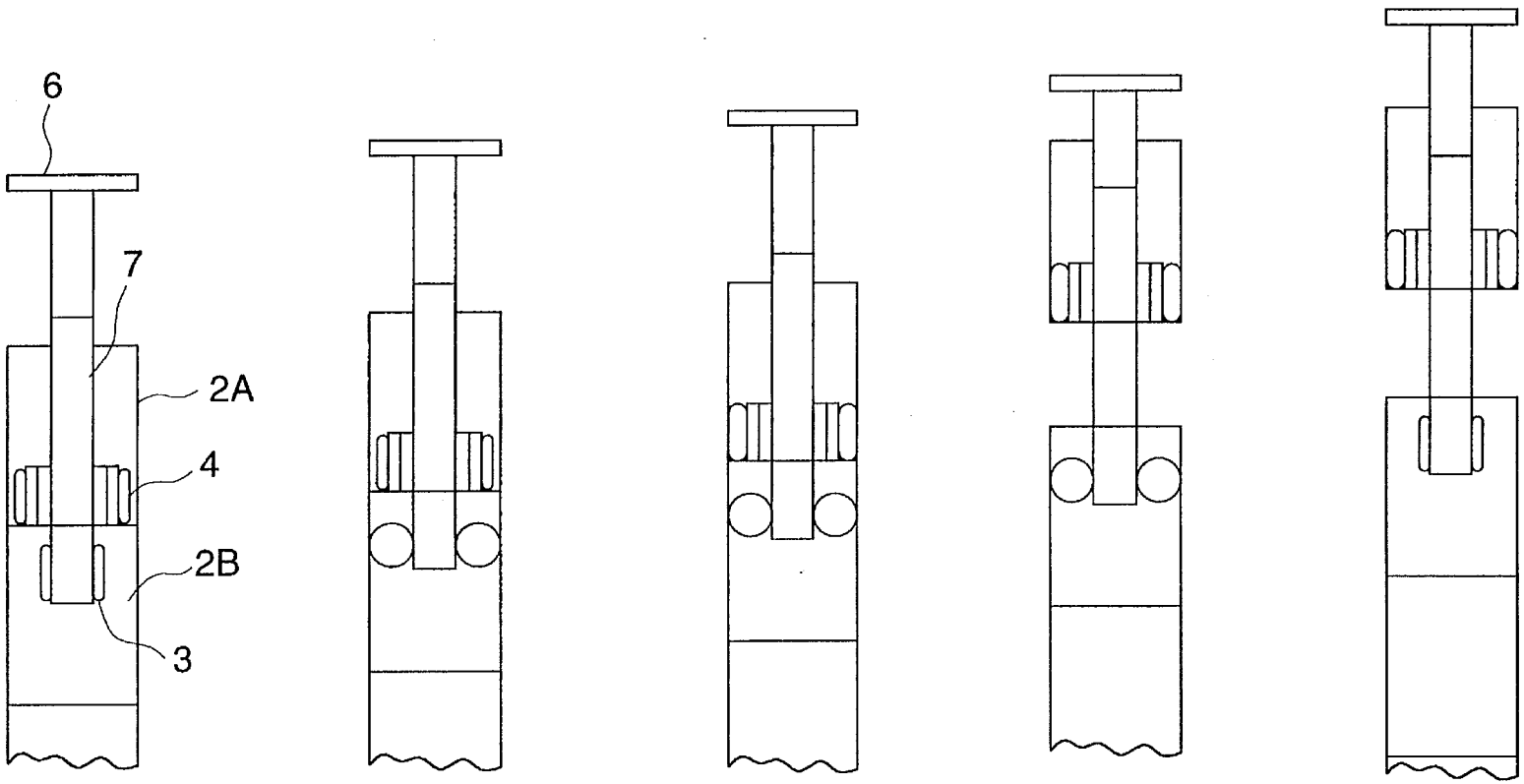
FIGS. 1(*a*) to 1(*e*) are schematic illustrations showing a separation process in the first method of the first embodiment of the present invention.

With reference to FIGS. 1(*a*) to FIG. 1(*e*), which are views for showing the process conditions, the first method of the first embodiment of the invention will be described, in which the continuous base drum on which the coating film has been coated and set in the above manner is separated.

The separating device includes a vertically moving robot stage 6, air cylinder 7, upper chuck 4 and lower chuck 3.

The coated base drum 2 is stacked and moved upward, and then reaches the separating position as illustrated in FIG. 1(*a*). At this time, the vertical robot is set in motion, and the entire separating unit is moved which is provided coaxially with the base drum to be separated.

First, at the position illustrated in FIG. 1(*b*), the lower chuck 3 holds the base drum 2B adjacent to the base drum 2A to be separated. Next, at the position illustrated in FIG. 1(*c*), the upper chuck 4 holds the base drum 2A to be separated.

While the upper chuck 4 is holding the base drum 2A to be separated, it is moved upward by the action of the air cylinder 7. Then the upper chuck 4 is positioned at a position illustrated in FIG. 1(*d*). At this time, the coating film striding the base drum 2A to be separated and the adjacent base drum 2B is torn away. Therefore, the base drums 2A and 2B are separated as illustrated in FIG. 1(*d*) by a tear between adjacent drums.

As illustrated in FIG. 1(*e*), in order to recover the separated base drum 2A, the lower chuck 3 is put in an unchucked condition, and the vertically moving robot stage 6 is suddenly raised, so that the separated drum 2A is put in the separated drum recovery device which is far higher than the adjacent base drum 2B, and the upper chuck 4 is put in an unchucked condition. In this way, the process is completed.

In preparation for the separating operation of the next base drum 2B, the vertically moving robot stage 6 is lowered, and also the air cylinder 7 is lowered. In this way, the device returns to the original position illustrated in FIG. 1(*a*).

In the case where the base drum 2A is separated from the adjacent drum 2B, it is effective to raise the base drum 2A to be separated while it is being rotated. By the method described above, not a tensile force but a shearing force is given to the film to be torn away. Due to the foregoing, the reduction of the thickness of the coating film close to the separating portion can be avoided. Further, the scatter of small pieces of the coating film caused when the film is torn away, can be reduced when the torn film is drawn into the inside surface of the base drum 2.

Vibration caused when the coating film is torn away, depends on the thickness, type and dry rate of the coating film. The occurrence of vibration can be reduced when the rigidity of the device is increased. However, as a result of the investigation, the inventors have found the following: It is very effective to perform a separating operation of the drum base in a period of time in which a non-image region at the end of the base drum 2 is passing through the coater disposed under the separating device.

Examples will be shown below, in which the base drums are continuously coated and separated by the aforementioned method and device.

EXAMPLE 1

Experimental conditions are described as follows. The coating solution was prepared in the following manner: 150 g of polycarbonate was dissolved in 1000 ml of 1,2-dichloroethane, so that a coating solution of which the viscosity was 110 cp was made. The coating solution was continuously applied to base drums with the coater 1 shown in FIG. 2(*a*) under the condition shown in FIG. 2(*b*), so that the dry layer of which the thickness was 28 μm was provided.

The coated film was quickly dried with the drier 24 shown in FIG. 3 immediately after the coating had been completed. In this case, the inner diameter of the cylindrical body 14 of the drier was 100 mm, the outside diameters of the base drums 2A, 2B and 2 were 80 mm, the velocity of the air flow in the pipe was 2 m/s, and the drying time was 60 s.

Under the above conditions, the base drums were continuously coated, dried and separated in accordance with the separation process shown in FIG. 1. As a result, the base drums were continuously coated and separated under a good condition.

EXAMPLE 2

In Example 2, the experiment was performed under the same condition as that of Example 1, except for one condition in which the base drum 2A was raised while the base drum 2A to be separated was being rotated, and 100 pieces of base drums were continuously coated and separated under a good condition. In this case, the defects caused by small pieces of torn film were not found.

Figure 4:
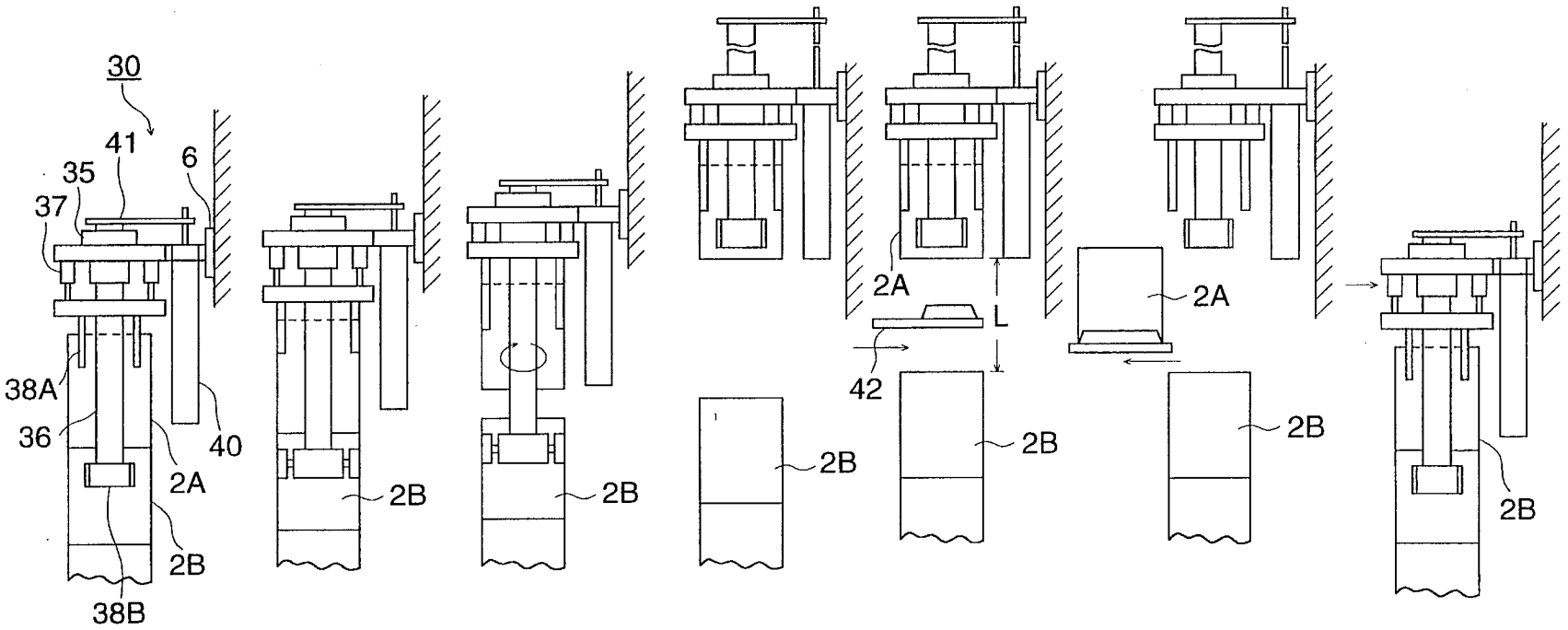
FIGS. 4(*a*) to 4(*g*) are schematic illustrations showing a separation process in the second method of the first embodiment of the invention.

With reference to the schematic illustration of FIG. 4 showing each process of separation, the second method of the first example will be explained as follows.

As shown in FIG. 4, the separation and recovery unit 30 includes a vertical movement robot stage 6, a separation cylinder 37 for a short distance movement, upper clamp member (upper chuck) 38A, lower clamp member (lower chuck) 38B, linear guide shaft 36, linear bush 35, cylinder 40 used for a lower clamp member movement means, cylinder connecting rod 41, and sliding table 42.

Under the condition shown in FIG. 4(*a*), while the separation and recovery unit 30 is waiting for the following operation, the coated base drum 2 is raised being dried and arrives at the separating position. At that time, the vertically traveling robot is set to start, and the entire separation and recovery unit 30 starts moving upward at the same speed as that of the base drum 2A to be separated, the base drum 2B adjacent to the base drum 2A, and the following base drum 2, wherein the movements are carried out concentrically. Then, as illustrated in FIG. 4(*b*), while the separation and recovery unit 30 is moved upward, the upper cramp member (upper chuck) 38A clamps the inside surface of the base drum 2A, and the lower clamp member (lower chuck) 38B clamps the inside surface of the base drum 2B.

After that, as illustrated in FIG. 4(*c*), while the upper clamp member (upper chuck) 38A and lower cram member (lower chuck) 38B are turned on, the cylinder 37 for separation, which is a short distance movement means, is activated, so that the base drum 2A to be separated and the base drum 2B adjacent to it are separated. It is preferable that the upper chuck 38A is rotated at that time so that the separation can be smoothly carried out. These circumstances are the same as those of the first method described before.

Then, as illustrated in FIG. 4(*d*), the lower chuck 38B is turned off and released, and the lower chuck 38*b* is lifted by the cylinder 30 used for movement, and further the stage 6 of the vertically traveling robot is suddenly raised. Therefore, the lower chuck 38B is accommodated in the base drum 2A to be separated held by the upper chuck 38A. In this case, the vertically traveling robot is stopped when a distance between the drums 2A and 2B becomes L which is sufficient for inserting the sliding table 42.

As illustrated in FIG. 4(*e*), the sliding table 42 is inserted between the drums 2A and 2B so that the sliding table 42 can receive the base drum 2A to be separated, that is, the sliding table 42 enters right below the drum 2A and right above the drum 2B. Under this condition, the stage 6 of the robot is lowered, so that the drum 2A is received on the sliding table 42. Then the stage 6 of the robot is raised again, and as illustrated in FIG. 4(*f*), the sliding table 42 returns to the initial position. In this way, the separation and recovery of the drum 2A can be realized.

It is preferable that the drum 2A is recovered when it is set on the sliding table 42 as illustrated in FIG. 4(*e*). Other than the above method, it is possible to recover the drum 2A with a manipulator in such a manner that the non-image portion of the drum 2A is directly held with a handle of the manipulator.

The following embodiment is also preferable: In order to separate and recover the drum 2A from the drum 2B, the cylinder 37 for separation is activated and/or the drum is rotated in a period of time when a non-image portion of each base drum 2 is coated, so that the image portion can not be affected by the vibration caused when the drum is separated.

Compared with the first method, the second method is advantageous in that: a stroke of the movement of the stage 6 of the vertically traveling robot is greatly reduced, so that the operation time of separation and recovery can be reduced. Further, according to the first method, the receiving means of the drum 2A to be separated is a complicated fork-shape. On the other hand, according to the second method, the receiving means of the drum 2A to be separated is a simple sliding table. Accordingly, the production efficiency can be improved. Concerning other functions, the first and second methods are approximately the same.

That is, in the same manner as that of the first method, according to the second method of the invention, a stable continuous coating and separating operation can be performed. As described before, the production efficiency of the second method is higher than that of the first method by 30 to 35%.

Next, the separation and recovery method of the second example of the present invention will be described as follows.

Figure 5:
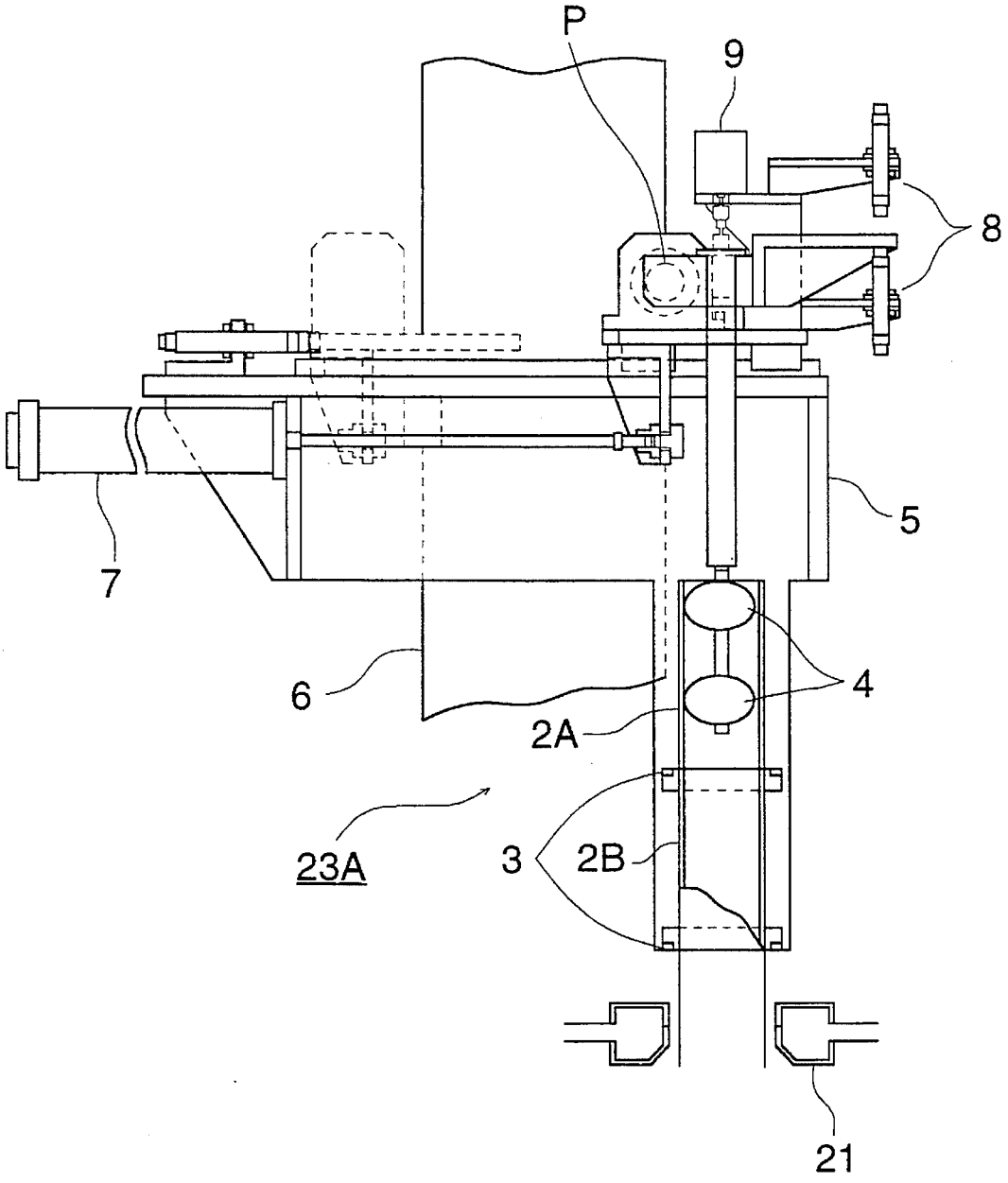
FIG. 5 is a side view showing the separating device used for the second embodiment of the present invention.
Figure 6:
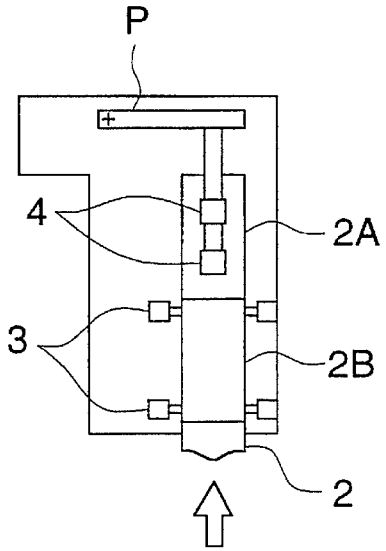
FIGS. 6(*a*) to 6(*d*) are schematic illustrations showing the flow of separation.
Figure 6:
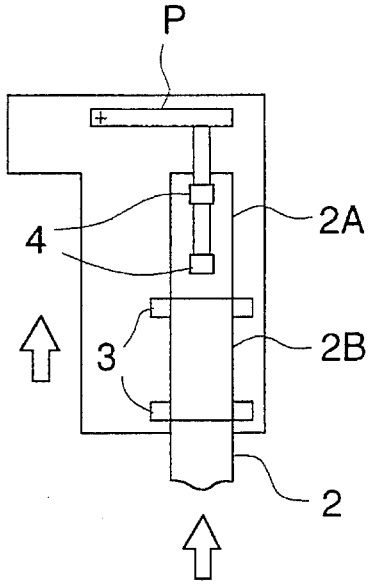
Figure 6:
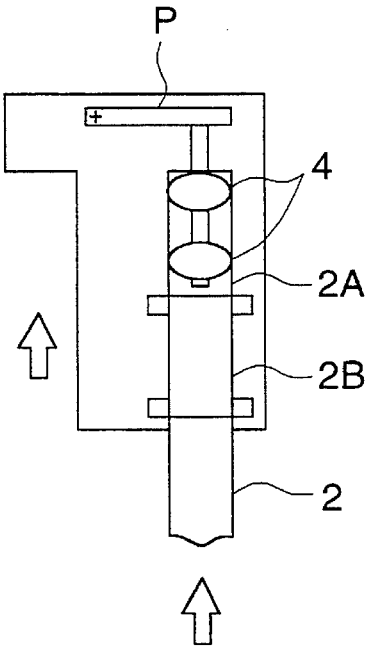
Figure 6:
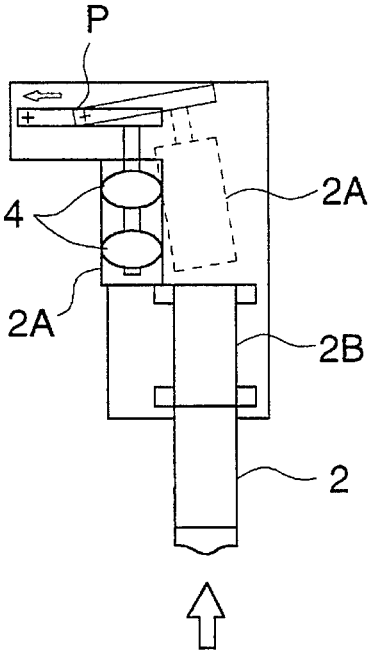

In the second example, the base drums 2 were coated and dried to the grade of "dry to touch". After that, the base drums 2 were separated by the separating device 23A shown in the side view of FIG. 5. With reference to FIGS. 5 and 6, the operation of the separating device 23A will be explained as follows, wherein FIG. 5 is a side view and FIG. 6 is a schematic illustration showing the flow of separation.

In FIG. 5, numerals 2A, 2B are base drums which have already been coated and dried. The base drums 2A, 2B are continuously moved upward at a constant speed. Numeral 6 is a vertical robot of a single shaft used for moving the unit at the same speed as that of the base drums 2A, 2B. The lower chuck 3, upper chuck 4, separation cylinder 7, shock absorber 8 and positioning cylinder 9 are mounted on the vertically moving single shaft robot 6 through the separation unit 5.

When the base drum to be separated has reached a predetermined position illustrated in FIG. 6(*a*), the robot 6 starts moving upward. Next, as illustrated in FIG. 6(*b*), the lower chuck 3 holds the base drum 2B which has already been coated and dried. Then, as illustrated in FIG. 6(*c*), the upper chuck 4 holds the base drum 2A to be separated which has already been coated and dried.

After the holding motion of the upper chuck 4 has been completed, as illustrated in FIG. 6(*d*), the upper arm is moved to the left by the air cylinder 7 for separation use. At this time, the lower end of the base drum to be separated and the upper end of the adjacent base drum are connected by the dry coating film, however, the connecting coating film is torn away by the force of the cylinder 7 for separation use.

When the base drums 2A and 2B are separated from each other, by the action of shearing force which is horizontally applied to the base drums, the base drum 2A and the upper chuck 4 are given a rotational moment to the left around the rotational center P. Therefore, the base drum 2A to be separated is a little raised from the base drum 2B. Under this condition, the base drum 2A is moved to the left. While the base drum 2A is moved to the left, both drums 2A and 2B are not contacted. Therefore, vibration is not caused in the base drums.

After the separation, the base drum 2A is transferred to the next process by another conveyance means. Then the upper chuck 4, lower chuck 3, separation cylinder 7 and vertically moving single shaft robot 6 are returned to their initial conditions in this order. Then the base drum 2B is changed to the base drum 2A to be separated. In this connection, numeral 9 is a cylinder for positioning the upper chuck 4. When the separated base drum is transferred to the next process, and also when each unit is returned to the initial condition, this cylinder 9 pushes the units downward. Except for that, the cylinder 9 is not activated.

Figure 10:
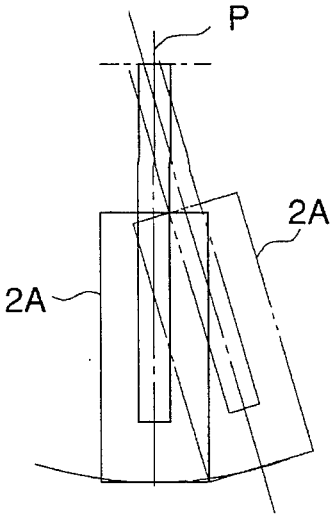
FIGS. 10(*a*) to 10(*c*) are schematic illustrations showing the horizontal movement of the drum, wherein the movement is expressed by a distance from the rotational center of the base drum to the axis of the drum.
Figure 10:
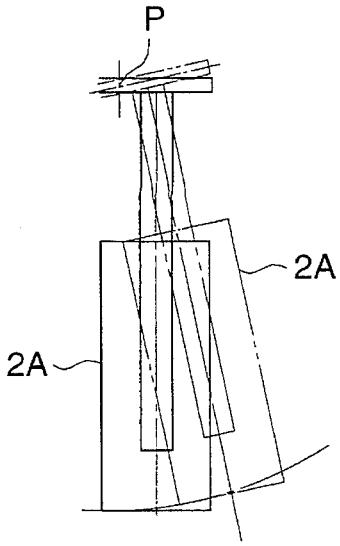
Figure 10:
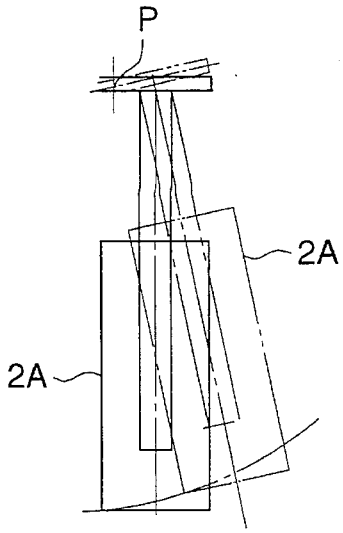

In this connection, the influence of eccentricity d is shown in FIG. 10. In this case, the eccentricity d is defined as a distance from the rotational center P of the base drum 2A held by the upper chuck to the axis of the base drum.

In FIG. 10(*a*), a locus of the base drum around the rotational center P is shown in the case of d=0. In this case, it can be seen that the drum end portion pushes down the lower base drum.

In this case, the radius of the base drum 2A is defined as r. When d=r, a locus shown in FIG. 10(*b*) is provided. In this case, the base drum can be rotated while the lower base drum 2B is not pushed downward.

In the case of d>r, the locus is shown in FIG. 10(*c*). In the same manner, the base drum can be rotated while the lower base drum 2B is not pushed downward.

However, in the case of d>>r, the base drum 2A to be separated tends to raise the base drum 2B right below it, so that a strong holding force is required for the lower chuck 3. Although the desirable condition depends on the strength of the coating film and lower chuck, and also depends on the holding force, the experimental desirable condition is expressed by the following inequality.

$$r \leqq d < 1.5r$$

It is necessary to maintain a gap formed by the angular moment between the lower end of the base drum 2A to be separated and the upper end of the base drum 2B arranged right below the base drum 2A until the separation is completed. It is possible to maintain the gad when the braking function for braking the right rotation around the shaft P is added.

The angular moment generated in the process of separation is determined by the angular moment around the shaft P shown in FIG. 5, and the speed of the cylinder 7 for separation use. In order to absorb the vibration caused by the counterclockwise rotation, the braking function is added.

Numeral 8 shown in FIG. 5 is a shock absorber having a restoring function. This shock absorber 8 absorbs the vibration to solve the above problems.

Figure 9:
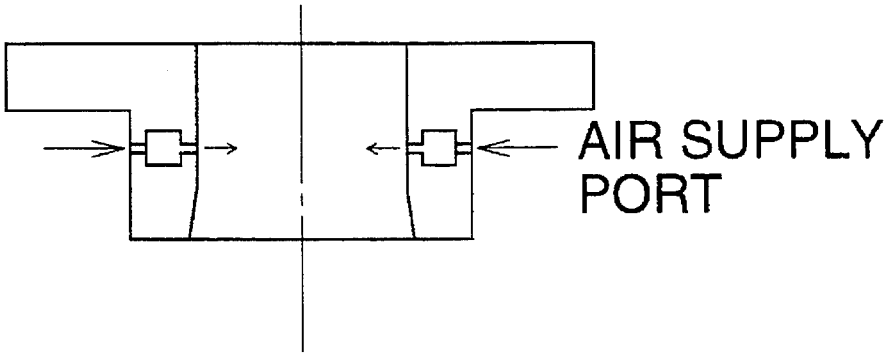
FIG. 9 is a sectional view showing another air support.

The air support 21 shown in FIGS. 5 and 9 is a means for centering in the noncontact condition. Since the base drums are positioned in a lower position and then stacked up continuously, the center of a base drum close to the separation device deviates at random due to the dimensional tolerance in the vertical direction of the base drum. When the separating operation is conducted without correcting the deviation of the center vibration is caused in the case where the lower chuck 3 holds and releases the base drum. When the air support 21 is used, the occurrence of vibration can be avoided.

Figure 7:
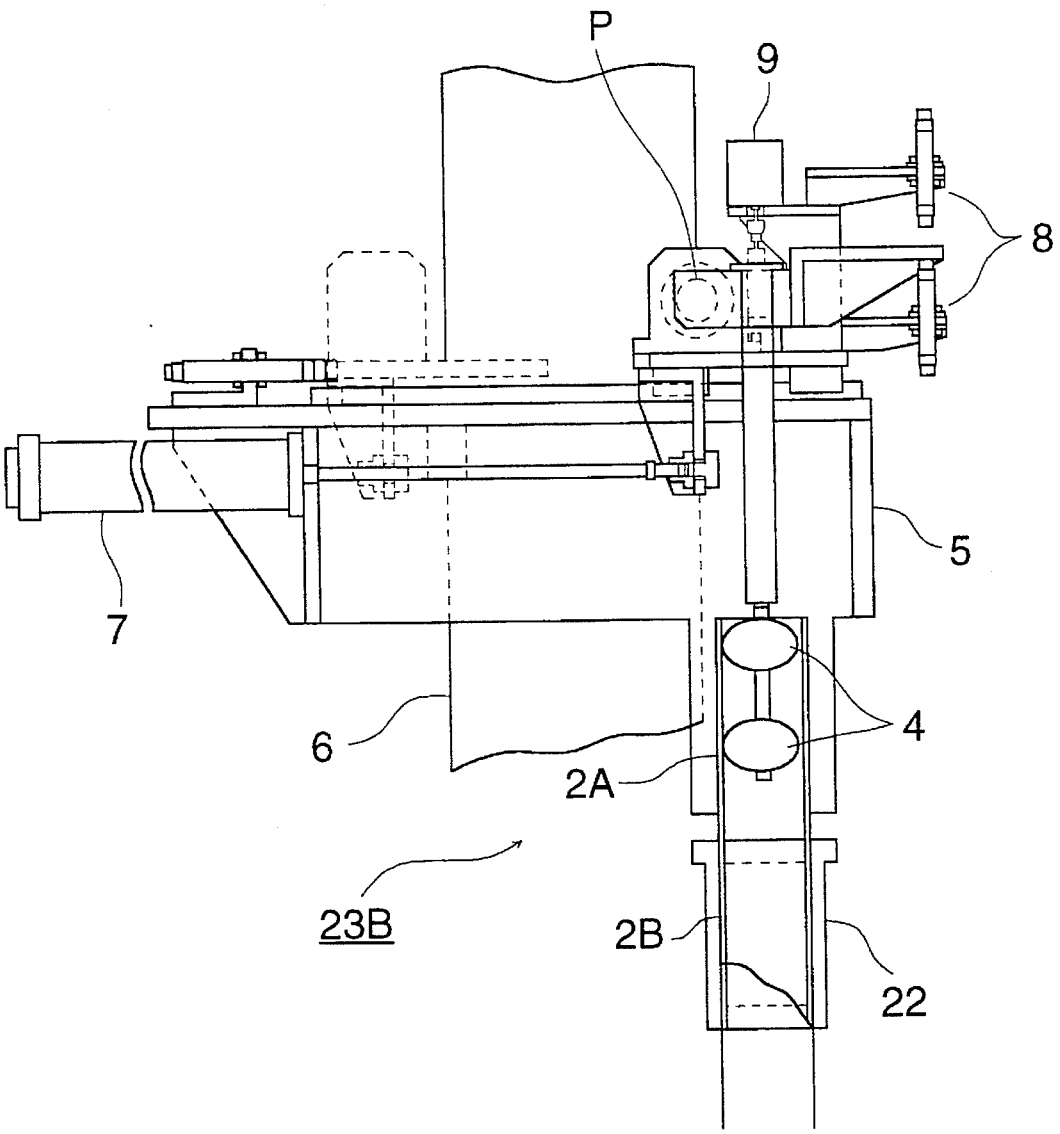
FIG. 7 is a side view showing another separating device used for the second embodiment of the present invention.

Numeral 22 shown in FIG. 7 satisfies the two conditions, one is the centering conducted under the noncontact condition, and the other is the supporting of lower base drum 2B in the case of separation. In this case, the air support 22 is necessarily longer than the air support 21.

An example is shown below, in which the continuous coating, drying and separating operation is performed using the apparatus described in the above example.

EXAMPLE 3

Experimental conditions are described as follows. The coating solution was prepared in the following manner: 140 g of polycarbonate was dissolved in 1000 ml of 1,2-dichloroethane, so that a coating solution of which the viscosity was 90 cp was made. The coating solution was continuously applied to base drums with the coater 1 shown in FIG. 2 under the condition shown in FIG. 3, so that the dry layer of which the thickness was 20 μm was provided.

The coated film was quickly dried with the drier 24 shown in FIG. 4 immediately after the coating had been completed. In this case, the inner diameter of the cylindrical body 14 of the drier was 100 mm, the outside diameters of the base drums A, 2B and 2 were 80 mm, the velocity of the air flow in the pipe was 2 m/s, and the drying time was 60 s.

Under the above conditions, the base drums were continuously coated, dried and separated using the separating device 23A shown in FIG. 5. As a result, the base drums were continuously coated and separated under a good condition.

EXAMPLE 4

Figure 8:
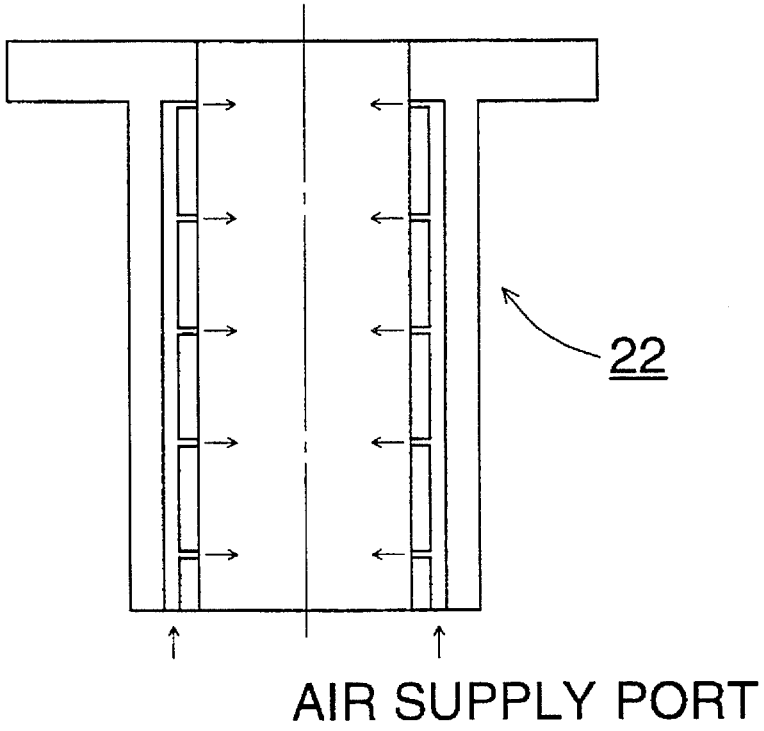
FIG. 8 is a sectional view showing the air support.

The separating device 23B shown in FIG. 7 is constructed in such a manner that the chuck 3 of the separating device 23A shown in FIG. 5 is replaced with the air support 22 shown in FIG. 8. An experiment was made using the separating device 23B shown in FIG. 7 under the same condition as that of Example 3, and good results were provided in the same manner as that of Example 3.

According to the first embodiment and the second embodiment of the present invention, the photoreceptor drums for electrophotography use can be continuously coated and dried while they are moved vertically being aligned in line. In this case, problems such as vibration and positional slippage are not caused in a portion of the base drum where a photosensitive solution is coated. Therefore, it becomes possible to smoothly separate the coating film at the boundary portion of base drums and to recover the base drums.

Consequently, it is possible to effectively produce photoreceptor drums of high quality at a high yield.

Next, an example in which the second object can be accomplished will be explained as follows.

In the drier of the present invention, air flows in a gap formed in the double cylinder so that the drying effect can be improved. However, in the case where the concentration of gas evaporated from the solvent is increased, the drying efficiency is lowered. Therefore, it is necessary to determine the air flow amount (air velocity) and the length of the cylinder so that the concentration of solvent gas is not saturated in the cylinder.

The evaporation speed of solvent contained in the coating film is affected by the vapor pressure of the solvent, temperature, and vapor density of the atmosphere. The vapor pressure is a physical property peculiar to the solvent, and the temperature is determined by the temperature in the coating room. Accordingly, in order to facilitate the drying action, the vapor density may be lowered. According to the present invention, the vapor density is lowered when an air flow collides with the coating film, so that the drying action can be facilitated.

Immediately after the coating operation has been completed, the evaporation speed of solvent is high. In this case, the coating film tends to be affected by a wind. When the coating film is dried somewhat, it is hardly affected by a wind, and at the same time the temperature of the base drum is lowered due to the latent heat of evaporation. In this case, a large amount of air of room temperature is permitted to flow so that the lowered temperature of the base drum can be compensated. From the viewpoint of reducing the solvent gas concentration in the cylinder, it is preferable to increase the amount of air.

In order to uniformly dry the drum, it is necessary that the suction speed of air is uniform in the circumferential direction. In the case where the suction speed is not uniform, the drying speed varies with respect to the circumferential direction. As a result, various problems are caused, for example, the coating film becomes uneven.

According to the present invention, in order to control the wind velocity (air quantity) with respect to the circumferential direction, a uniform pressure loss is made with respect to the circumferential direction.

Figure 12:
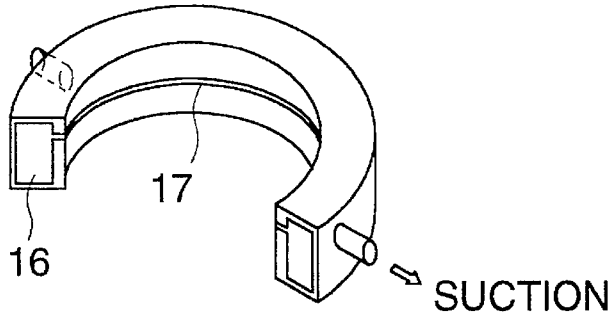
FIG. 12 is a partially sectional perspective view of the suction member in which a suction slit is provided.

As the construction is shown in FIG. 12 which is a partially sectional perspective view, a ring-shaped suction chamber 16 and a slit which is uniform with respect to the circumferential direction, are provided, and a negative pressure is given to the suction chamber in which the pressure loss is small, and the uniform slit 17 is used as a pressure loss member.

Figure 13:
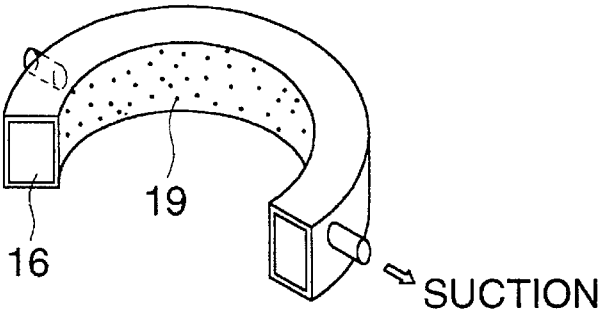
FIG. 13 is a partially sectional perspective view of the suction member in which a punched board is provided instead of the suction slit.
Figure 14:
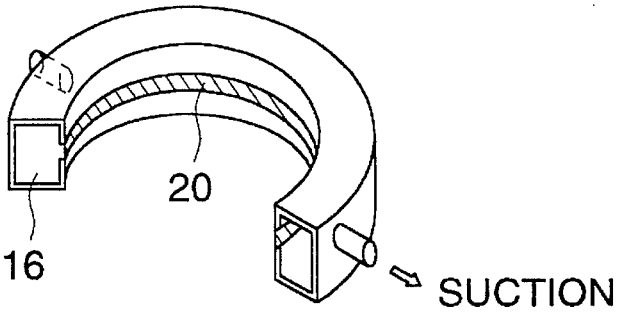
FIG. 14 is a partially sectional perspective view of the suction member in which a net of meshes is provided instead of the suction slit.

As a means for uniformly sucking air with respect to the circumferential direction, instead of the circumferentially uniform slit, a punched plate 19 shown in FIG. 13 and a plate of meshes 20 shown in FIG. 14 may be used to accomplish the same object.

In order to change the balance in the air quantity and wind velocity between upper and lower portions in the cylinder of the present invention, the inner diameter and length of the cylindrical member 14 shown in FIG. 3, which is a cylinder to make the air flow uniform, may be changed. The following experiments verify the advantages of the present invention described above.

The common conditions of the experiments 5 and 6 are described as follows.

(a) Coater Distance between the driers:200 mm (b) Measurement position: Measurement was made at an end of the cylindrical member (c) Coating solution:140 g of polycarbonate was dissolved 1000 ml of 1,2-dichloroethane, so that a coating solution of 90 cp of viscosity was made.

(d) Dry film thickness:20 μm

The experiments were made using the apparatus, the construction of which is illustrated in FIGS. 2(*a*), 2(*b*), 3 and 11.

Figure 11:
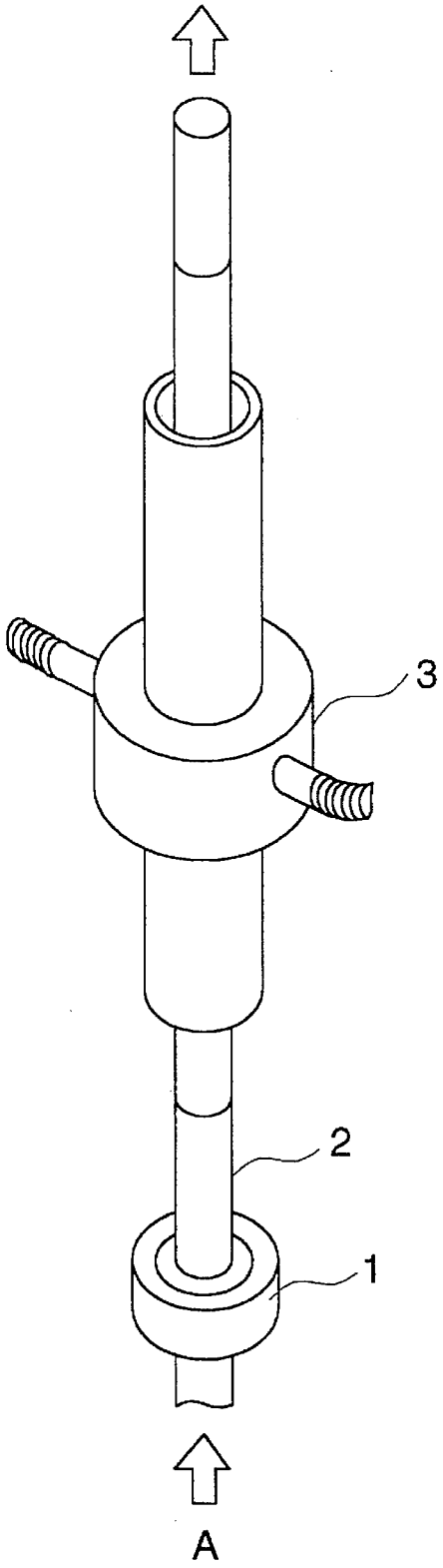
FIG. 11 is an overall arrangement view of the coating and drying device.

In FIG. 11 which is an overall arrangement view, numeral 1 is a coater used for coating, and numeral 2 is a hollow base drum made of aluminum, which is used for the photoreceptor drum of electrophotography. The base drums 2 are stacked upward and conveyed in a direction shown by the arrow A. When the base drum 2 passes through the coater 1, it is coated with the coating solution and then conveyed to the drier of the present invention. In the drier, the solvent contained in the coating film 7 is removed.

FIG. 2(*a*) is a partially sectional view of the coater 1. In FIG. 2(*b*), which is a sectional view, the base drum 2 and coater 1 are illustrated which are in a coating condition. The coating solution is supplied from the coating solution distribution chamber 10, and flows in the coating solution slit 11. Then the coating solution flows down on the sliding surface 12. In this way, the coating film 13 is formed on the surface of the base drum 2.

FIG. 3 is a sectional view of the drier 3 of the present invention. The drier 24 includes: a suction slit member 15 having a suction slit 17, suction chamber 16 and suction nozzle 20; and cylinder members 14, which are concentrically attached to the upper and lower portions of the suction slit member 15.

The sucking operation is conducted by a plurality of suction nozzles 20, and then the sucked air flow is made uniform with respect to the circumferential direction by the action of the suction chamber 16 and the suction slit 17 which are constructed to be uniform with respect to the circumferential direction. In this case, a turbulence of air is caused in a space formed between the inner surface of the suction slit member 15 and the outer circumferential surface of the coated base drum 2, and a turbulence of air is also caused in a space formed between the inner surfaces of the upper and lower cylindrical members 14 and the outer circumferential surface of the coated base drum 2. The turbulence is a little suppressed by a buffer space 19, and a uniform air flow 18 is made for drying the base drum.

When the coated drum 2 is conveyed to the drying zone in the arrowed direction, the coating film is dried.

Experiment 5 is described as follows.

Experiment 5

In Experiment 5, the inner diameter and wind velocity of the cylindrical member 14 were changed. The results are shown in Table 1.

TABLE 1

| | (14) Inner diameter | Average wind velocity | Deviation of film thickness | Re (Reynold's number) |
|---|---|---|---|---|
| Example 1 | ϕ100 | 1 m/S | o | $6.7 \times 10^2$ |
| Example 2 | ϕ100 | 5 m/S | o | $3.3 \times 10^3$ |
| Example 3 | ϕ100 | 8 m/S | o | $5.3 \times 10^3$ |
| Example 4 | ϕ150 | 1 m/S | o | $2.3 \times 10^3$ |
| Comparative example 1 | ϕ100 | 10 m/S | x | $6.7 \times 10^4$ |
| comparative example 2 | ϕ150 | 5 m/S | x | $1.2 \times 10^4$ |
| Comparative example 3 | No | (2 m/S) | x | |

o = the deviation is not more than ± 0.5 μm

In this case, Re is the Reynold's number, that is, Re=Ud/μ, $\mu=1.5\times10^{-5}$ $m^2/s$, U=m/s, and d=m. According to Table 1, when $Re \leqq 5.3\times10^3$, the coating film can be dried in a good condition in the initial stage.

If the air flow is insufficient, the good initial dry process may not be conducted. Accordingly, $1.3\times10^2 \leqq Re$ may be preferable. When $1.3\times10^2 \leqq Re < 5.3\times10^3$, the good initial dry process can be conducted on such a condition.

In Experiment 5, the length of the cylindrical member 14 was determined to be 400 mm. The outer diameter of the base drum was 80 mm, and the speed of the moving base drum was set at 20 m/s.

When the film thickness deviation is not more than ±0.5 μm, it is defined to be good, and denoted by the mark ○.

Next, Experiment 6 will be described as follows.

Experiment 6

In Experiment 6, the inner diameter and length of the upper and lower cylindrical members 14 were changed, and others were the same as those of Experiment 5. The results of Experiment 6 are shown in Table 2.

○. When the deviation exceeds the above value, it is judged to be "no good" and expressed by the mark ×.

According to Table 2, it is judged that the following conditions are advantageous for drying the coating film quickly without affecting it:

In the case where a base drum enters the cylindrical member 14 which is the entrance of the drier 3 after the base drum has passed through the coater 1, the condition of $Re < 5.3\times10^3$ is observed. Further, after the coating film has been fixed, the wind velocity is increased, and the length of the drying zone is extended.

[Experiment 7]

In order to clarify a relation between the wind speed and the rate of drying, the following experiment was further made.

Figure 15:
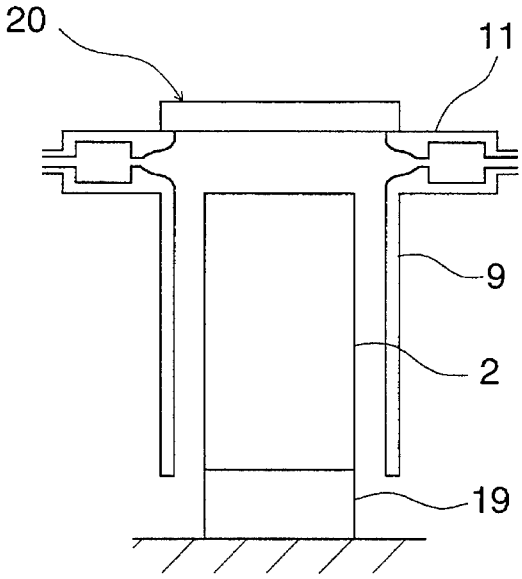
FIG. 15 is a sectional view showing an experimental apparatus used in Experiment 7.

The experimental apparatus was constructed as illustrated in FIG. 15. The same coating solution as that used in the above example was used in this experiment, and also the thickness of the coating film was the same as that of the above example. In FIG. 15, numeral 19 is an electronic balance to weigh the drum 2, and numeral 20 is a cover of the hole through which a drum is charged into the experimental apparatus.

Figure 16:
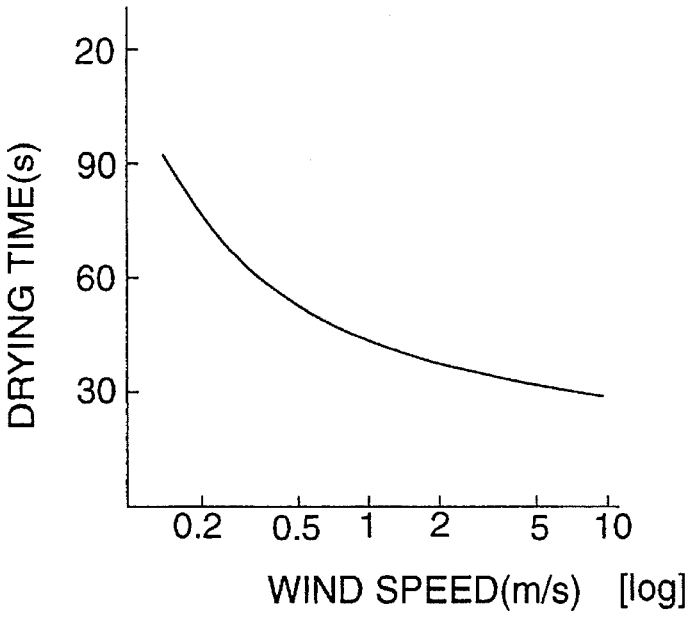
FIG. 16 is a characteristic diagram of wind speed and drying time.

Using the coating device shown in FIGS. 2(*a*) and 2(*b*), a uniform coating film was formed on a drum. This coated drum was put into the drying device shown in FIG. 15, and the reduction of weight caused by the evaporation of solvent was measured together with the time. In this experiment, the wind speed of an air flow between the drum and the drier was changed, and a period of time was investigated in which an amount of residual solvent contained in the coating film became 20%. The result of the experiment is shown in FIG. 16.

In the case where the drier was not used at all, that is, under the natural drying condition, the drying time was 75 seconds.

TABLE 2

| | Lower cylindrical member 9 Inner diameter/Length | Upper cylindrical member 10 Inner diameter/Length | Lower cylindrical member 9 Wind velocity/Re | Upper cylindrical member 10 Wind velocity/Re | Film thickness deviation |
|---|---|---|---|---|---|
| Example 1 | ϕ95/400 | ϕ100/400 | 7 m/S / $3.5 \times 10^3$ | 13 m/S / $8.6 \times 10^4$ | o |
| Example 2 | ϕ95/400 | ϕ100/800 | 7 m/S / $3.5 \times 10^3$ | 12 m/S / $8.0 \times 10^4$ | o |
| Comparative Example 1 | ϕ100/400 | ϕ100/400 | 10 m/S / $6.7 \times 10^4$ | 10 m/S / $6.7 \times 10^4$ | x |

In this case, the residual solvent was measured in the following manner:

Weight of the base drum was measured immediately after it had passed through the drier. Weight of the base drum was measured after it had been dried in a drying furnace of 100° C. for 90 min. Theoretical weight was found immediately after the base drum had been coated using the aforementioned values, the residual solvent % was calculated.

$$\text{Residual Solvent } \% = \frac{A-B}{C} \qquad \text{[Expression 1]}$$

where A is the weight of a base drum immediately after it has passed through the drier, B is the weight of a drum in a dry condition, and C is the theoretical weight of solvent contained in the coating solution required for one base drum.

When the deviation of film thickness is not more than ±0.5 μm, it is judged to be good and expressed by the mark As a result of the above experiment, it was found that the drying effect was facilitated in this apparatus when the wind speed was not less than 0.2 m/s.

Although the configuration of the experimental apparatus illustrated in FIG. 15 is different from that illustrated in FIG. 3, the essential principle of drying is the same, in which a flow of air is generated between the inner wall of the cylindrical member and the surface of the coated drum. Therefore, the obtained results are the same. In this connection, in the experiment, the temperature was 23° C., and the humidity was 43%.

According to the present invention, the occurrence of a turbulence can be prevented at a position close to the surface of a coating film immediately after the coating operation has been completed. Accordingly, the solvent can be quickly evaporated and removed, so that the coating film can be completely dried without being affected. Accordingly, photoreceptor drums of high quality used for electrophotography can be effectively produced.

What is claimed is:

1. A method of manufacturing a photoreceptor drum which has a coated dried photosensitive layer formed thereon, the photoreceptor being usable in electrophotography, comprising the steps of:

stacking a plurality of base drums in a vertical direction coaxially in a stack so that a lower end portion of a drum higher in the stack comes in contact with an upper end portion of another drum lower in the stack, each drum having an inner wall and an outer wall;

moving the stacked plurality of base drums in an upward direction, at a predetermined speed;

coating a photosensitive layer on each of the stacked plurality of base drums while the stacked drums are being moved in the upward direction;

drying the photosensitive layer on the stacked base drums, wherein the coating and the drying steps occur sequentially from an uppermost base drum toward a lowermost base drum;

separating the coated and dried uppermost base drum from a next base drum lower in the stack and adjoining the uppermost base drum while conducting the moving step, the coating step and the drying step on drums lower in the stack than the uppermost base drum, the separating step including:

holding one of the inner wall and the outer wall of the next base drum with a first holding member in such a manner as to maintain the next base drum coaxially aligned with the stacked plurality of base drums and moving the first holding member at a same speed that is equal to the upward predetermined speed of the stacked plurality of base drums; and holding the uppermost base drum with a second holding member and moving the second holding member so as to cause the uppermost base drum to relatively move from the next base drum so that the uppermost base drum is separated by the second holding member from the next base drum while the next base drum is maintained coaxially aligned with the stacked plurality of base drums by the first holding member, the separated uppermost base drum being a photoreceptor drum which has a dried photosensitive layer thereon.

2. The method of claim 1, wherein the holding step of the separating step positions the first holding member to hold the inner wall of the next base drum lower in the stack.

3. The method of claim 1, wherein the holding step of the separating step positions the first holding member to hold the outer wall of the next base drum lower in the stack.

4. The method of claim 1, wherein the first holding member used in the separating step comprises an air-jet device that positions the outer wall of the next base drum by the use of air.

5. The method of claim 1, wherein the holding step during the separating step comprises applying a rotational force to the second holding member.

6. The method of claim 1, wherein at least one of the stacked base drums has a non-image region and wherein the second holding member separates the uppermost base drum from the next base drum when another base drum other than the uppermost base drum is being coated on a portion thereof that corresponds to the non-image region of the at least one base drum.

7. The method of claim 1, wherein the drying step comprises drying the coating with a dryer that includes a cylinder in which one of the base drums is accommodated, and a ring-shaped suction member that is positioned coaxially at a middle portion on an outer wall of the cylinder, wherein the suction member is arranged to suck air uniformly through an opening of the outer wall of the cylinder.

8. The method of claim 7, wherein the drying step comprises creating an air flow with said ring-shaped suction nozzle which flows between an inner wall of the cylinder and an outer wall of the one base drum accommodated in the cylinder.

9. The method of claim 8, wherein the drying step comprises controlling the air flow to satisfy a relationship of $1.3\times10^2 \leqq Re \leqq 5.3\times10^3$, wherein Re is a Reynold's number.

10. The method of claim 9, wherein the drying step comprises controlling a speed of the air flow to be not less than 0.2 m/s.

11. The method of claim 7, wherein the drying step comprises forming a lower portion of the ring-shaped suction member to have a diameter that is smaller than a diameter of another portion of the ring-shaped suction member that is positioned to be in a direction above the lower portion of the ring-shaped suction member.

12. The method of claim 1, wherein the coating step comprises coating the stacked base drums by use of a ring-shaped slide coater that slides over the stacked base drums which are stacked in a vertical direction.

13. The method of claim 1, wherein the second holding member moves the uppermost coated base drum upwardly in relation to the next base drum.

14. The method of claim 1, wherein the second holding member rotates the uppermost coated base drum in relation to the next base drum.

* * * * *